United States Patent [19]

Horton

[11] 4,294,444

[45] Oct. 13, 1981

[54] PIPE GRIPPING VISE

[75] Inventor: Herbert D. Horton, Mayhill, N. Mex.

[73] Assignee: World Wide Oil Tools, Inc., Houston, Tex.

[21] Appl. No.: 145,367

[22] Filed: Apr. 29, 1980

[51] Int. Cl.[3] ..... B25B 1/08

[52] U.S. Cl. ..... 269/156; 269/32; 269/34; 269/229; 269/239

[58] Field of Search ..... 269/156, 239, 229, 232, 269/233, 32, 34

[56] References Cited

U.S. PATENT DOCUMENTS 328,102 10/1885 Bauer ..... 269/239

2,747,445 5/1956 McConnell et al. ..... 269/239

FOREIGN PATENT DOCUMENTS 2542959 3/1977 Fed. Rep. of Germany ..... 269/156

*Primary Examiner*—Robert C. Watson

*Attorney, Agent, or Firm*—Vinson & Elkins

[57] ABSTRACT

An improved vise for gripping elongated objects such as pipe is provided. The vise utilizes the rotational forces acting upon the object to be gripped to tighten the vise's grip on the object. The vise is constructed so that any force tending to rotate the object is transmitted to the vise and is translated into a gripping force to be utilized by the vise jaws of the vise. The vise is bi-directional and automatic in its operation.

2 Claims, 3 Drawing Figures

PIPE GRIPPING VISE

BACKGROUND OF THE INVENTION

The present invention is an improved vise for gripping elongated objects such as pipe used in the oil and gas producing industry. The vise is designed to restrain the rotation of such objects while the objects are in the vise's grip.

The vise finds particularly useful application in the hydraulic testing of casing and other large diameter pipe used in the production of oil and gas. The hydraulic testing of such pipe is generally accomplished by mounting and securing the pipe on a hydraulic pipe testing apparatus, sealing both ends of the pipe with watertight plugs, introducing hydraulic test fluid into the pipe through an aperture in one of the plugs, filling the pipe with the hydraulic test fluid, increasing the hydraulic pressure on the hydraulic test fluid in the pipe to a pre-determined level and then visually inspecting the external areas of the pipe to check for leaking hydraulic test fluid. When pipe is tested with hydraulic test fluid under high test pressure, structurally flawed pipe may burst due to the great internal pressure of the hydraulic test fluid on the walls of the pipe.

Both rotational and translational forces may act upon a pipe when it is mounted in a pipe testing apparatus. Translational forces tend to cause the pipe to move laterally or vertically with respect to the apparatus and rotational forces tend to cause the pipe to rotate either clockwise or counterclockwise with respect to the apparatus. Because the rotary motion of the pipe can cause the vise jaws securing the pipe to the pipe testing apparatus to loosen and permit the pipe to be thrown from the apparatus, it is very desirable for a vise to have the capability to restrain the rotational motion of a pipe clamped in the vise's grip. Because the possibility exists that the pipe may reverse its direction of rotation quickly and unexpectedly, it is also desirable that the vise have the capability to automatically adjust its mode of operation to restrain either clockwise or counterclockwise rotary motion. In addition to the foregoing, the vise must have sufficient strength to restrain the pipe against any translational forces acting upon it.

The improved vise which comprises the present invention meets the requirements set forth above. As will be more fully discussed below, the improved vise of the present invention utilizes the rotational forces acting upon the pipe to tighten the vise's grip on the pipe. The vise is constructed so that any force tending to rotate the pipe is transmitted to the vise and is translated into a gripping force to be utilized by the vise jaws of the vise.

SUMMARY OF THE INVENTION

An object of the present invention is to provide a power driven vise for gripping elongated objects such as pipe.

For convenience, such elongated objects will hereafter generally be referred to as "pipe" even though the vise's utility is not strictly limited to gripping pipe only.

An additional object of the present invention is to provide a power driven vise specially designed and constructed to utilize rotational forces acting upon a pipe to be gripped to tighten the vise's grip on the pipe.

An additional object of the present invention is to provide a power driven vise with automatically reversible pipe gripping means for quickly and automatically restraining either clockwise or counterclockwise rotary motion of a pipe to be gripped.

The improved vise of the present invention comprises a frame of two parallel vertically mounted support plates for supporting the pipe to be gripped; two pipe gripping vise jaws mounted therebetween for gripping the pipe; a housing for containing and supporting said frame; a vertically movable yoke having arms mounted within said housing for urging said vise jaws into gripping contact with the pipe, said yoke being movable in response to a force applied by a hydraulic cylinder or some other similar power source; and, wedge-shaped flanges on said vise jaws forming a part of said vise jaws for translating rotational forces acting on the pipe into a gripping force exerted on said pipe by said vise jaws.

Other objects and advantages of the invention will be hereinafter described or will become apparent to those skilled in the art, and the novel features of the invention will be defined in the appended claims.

DESCRIPTION OF THE PREFERRED EMBODIMENT

Figure 1:
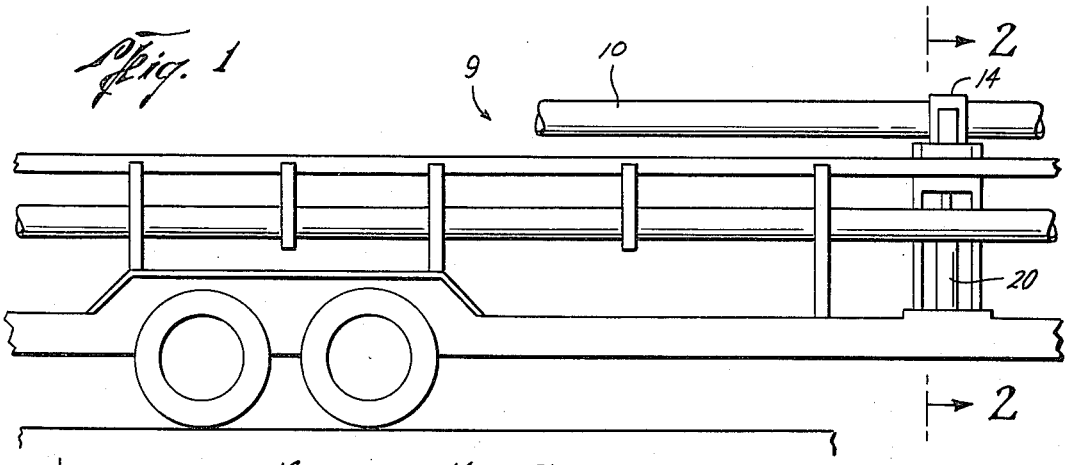
FIG. 1 is a side view of a portion of a typical hydraulic pipe testing apparatus showing the placement of the pipe vise on the pipe testing apparatus.
Figure 2:
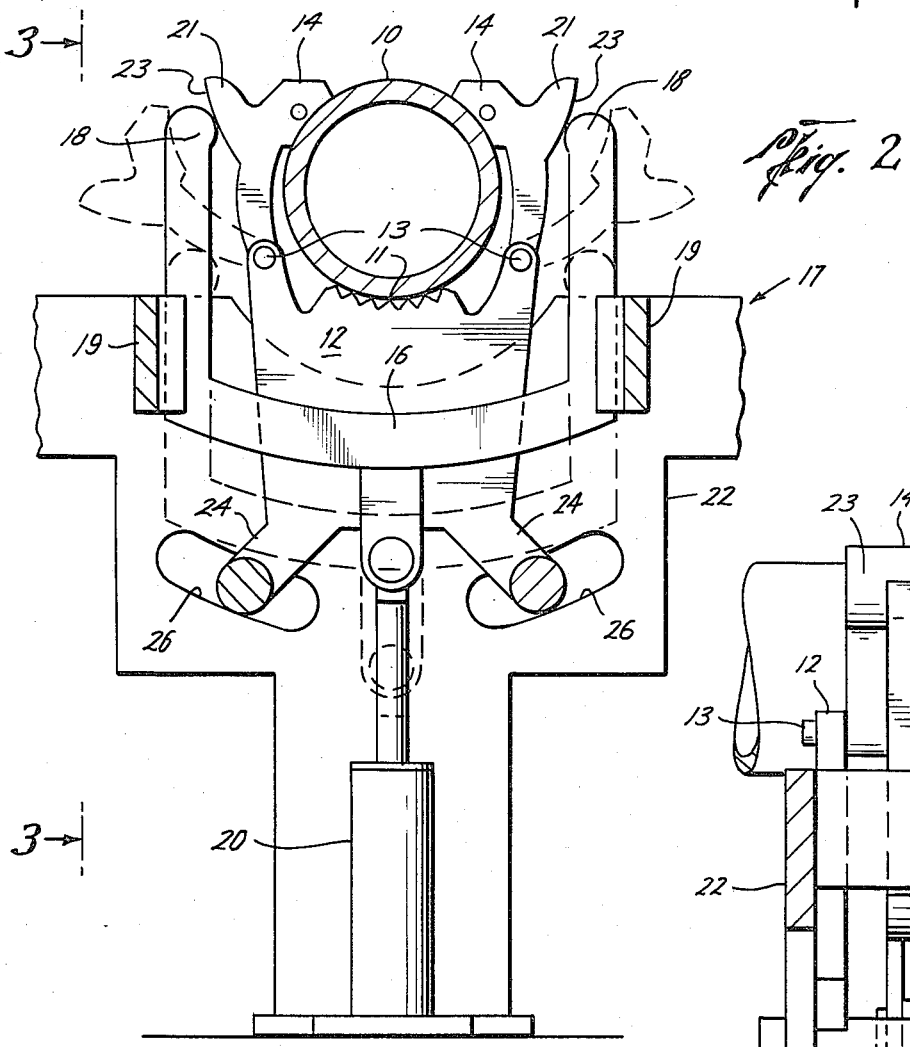
FIG. 2 is a longitudinal cross-sectional view of the pipe vise as shown in FIG. 1 taken along line 2—2 thereof showing the movement of the vise jaws into gripping contact with the pipe in response to the vertical movement of the yoke.
Figure 3:
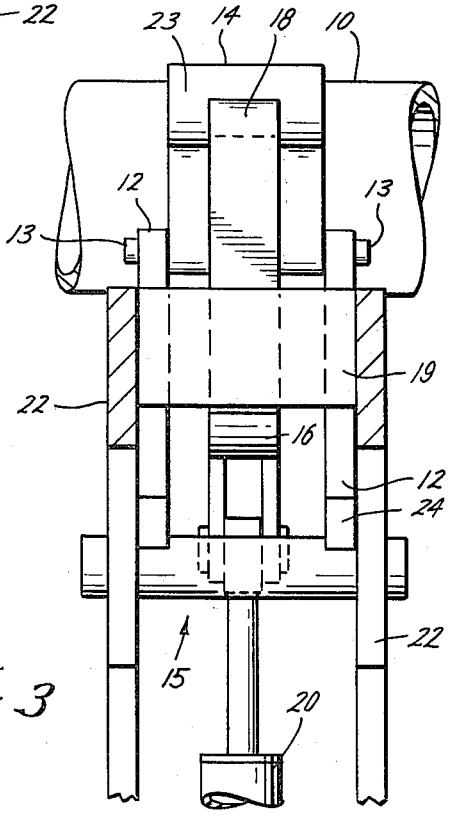
FIG. 3 is a side cross-sectional view of the pipe vise showing the movement of the yoke with respect to the vise jaws.

The presently preferred embodiment of the present invention is shown in FIGS. 1-3. The pipe testing apparatus shown in FIG. 1 is denoted by the number 9 and the pipe to be gripped is denoted by the number 10. As shown in FIGS. 2 and 3, pipe 10 rests upon and is supported by the upper edge 11 of two parallel vertically mounted support plates 12. Two pipe gripping vise jaws 14 are pivotally mounted between the support plates 12 as shown in FIGS. 2 and 3. Pivots 13 pass through apertures in the upper corners of support plates 12 and through apertures in the bottom sections of vise jaws 14 to provide pivotal support to vise jaws 14. Support plates 12 and pivots 13 form a frame generally denoted by the number 15. In addition to performing other functions to be later described, frame 15 provides support for pipe 10 and pivotal support for vise jaws 14.

Frame 15 is supported and contained within a housing generally denoted by the number 17. Housing 17 comprises two parallel vertically mounted housing walls 22 fixedly mounted to pipe testing apparatus 9 at right angles to the length of the pipe testing apparatus 9. Each housing wall 22 possesses two slots 26 as shown in FIG. 2 adapted to receive and guide a leg 24 forming a lower portion of support plate 12. The function of the slot 26 and leg 24 arrangement will be discussed more fully below.

The housing walls 22 are fixedly mounted on pipe testing apparatus 9 with just enough distance between them to accommodate frame 15. As shown in FIG. 3, frame 15 has no bottom so that yoke 16 may freely move vertically between the parallel support plates 12. Frame 15 remains in place between housing walls 22 because legs 24 of support plates 12 rest in slots 26 of housing walls 22.

Now consider the structure and function of yoke 16. As shown in FIGS. 2 and 3 a yoke 16 having two arms 18 rests between support plates 12 of frame 15. Yoke 16 is supported by hydraulic cylinder 20 which is vertically disposed with respect to pipe testing apparatus 9. Hydraulic cylinder 20 provides the power to move yoke 16 up and down with respect to frame 15 and housing 17. The vertical motion of yoke 16 is guided by yoke arm guides 19. A yoke arm guide 19 fixedly mounted on each side of the pipe testing apparatus 9 between support plates 12 of frame 15 guides the motion of a yoke arm 18 to center the yoke 16 and yoke arms 18 with respect to the vise jaws 14. The yoke arms 18 are placed on yoke 16 so that yoke arms 18 slidably communicate with and lift vise jaws 14 as yoke 16 is moved vertically under the action of hydraulic cylinder 20. The length of yoke arms 18 is such that vise jaws 14 will grippingly engage a pipe 10 resting on the upper edge 11 of support plate 12 when yoke 16 is moved vertically between the support plates 12 of frame 15. When vise jaws 14 have grippingly engaged the pipe 10, yoke arms 18 are firmly wedged against vise jaws 14 and yoke 16 may not be moved further upwardly. Increasing the hydraulic pressure on hydraulic cylinder 20 under such circumstances would only serve to increase the gripping strength being exerted on the pipe 10 via pipe jaws 14.

Each vise jaw 14 possesses a wedge-shaped flange 21 which forms a part of said vise jaw 14. As shown in FIG. 2, each wedge-shaped flange 21 possesses a slightly convex exterior surface 23. The ends of yoke arms 18 slide against the slightly convex exterior surfaces 23 when yoke 16 is moved vertically by hydraulic cylinder 20.

The wedge-shaped flanges 21 of vise jaws 14 permit a rotational force acting on pipe 10 to be transformed into a gripping force to tighten the grip of vise jaws 14 on pipe 10. Consider, for example, the operation of the various parts of the vise. The pipe 10 to be gripped is rested upon the upper edge 11 of support plates 12. Hydraulic cylinder 20 is activated to move yoke 16 vertically, thereby causing yoke arms 18 to slide vertically guided by yoke arm guides 19. Yoke arms 18 lift vise jaws 14 into place beside pipe 10. As yoke arms 18 slide along the slightly convex exterior surfaces 23 of the wedge-shaped flanges 21 of vise jaws 14, yoke arms 18 wedge vise jaws 14 into gripping contact with pipe 10. If no unbalanced rotational force is acting on pipe 10, then the entire system is in equilibrium and no motion occurs.

Now consider the situation described immediately above if the pipe 10 moves in a clockwise direction. As pipe 10 turns clockwise, it tends to press one of the vise jaws 14 (denoted first vise jaw) downwardly toward the support plates 12 of frame 15. Said first vise jaw is wedged between pipe 10 and one of the yoke arms 18 (denoted first yoke arm). As rotary force is imparted to frame 15 via first vise jaw 14 frame 15 begins to turn in a clockwise direction with respect to housing 17. Frame 15 possesses this freedom to rotate due to the leg 24 and slot 26 coupling between frame 15 and housing 17. Slot 26 is not more than a few inches wide, however, because frame 15 does not move far with respect to housing 17 before coming to equilibrium again due to the tightening of the vise described below.

As frame 15 moves in a clockwise manner, the end of first yoke arm 18 moves upwardly in frictional sliding contact with the slightly convex exterior surface 23 of the wedge-shaped flange 21 of first vise jaw 14. As hydraulic cylinder 20 maintains upward pressure on yoke 16 and yoke arms 18, the slight clockwise rotation of frame 15 causes wedge-shaped flange 21 of first vise jaw 14 to rotate downwardly with respect to the end of first yoke arm 18. The increasing thickness of metal between pipe 10 and the end of first yoke arm 18 caused by the outward flaring of wedge-shaped flange 21 of first vise jaw 14 causes a greater wedging force to be exerted on pipe 10 than was exerted on pipe 10 before frame 15 rotated in response to the rotational force transmitted to it from pipe 10.

Because yoke 16 transmits the force exerted by hydraulic cylinder 20 to the remaining yoke arm 18 (denoted second yoke arm) as well as to the first yoke arm 18, second yoke arm 18 also experiences an upward force. The clockwise rotation of frame 15 causes the remaining vise jaw 14 (denoted second vise jaw) to rotate in an upward direction with respect to pipe 10. The end of second yoke arm 18 moves downwardly in frictional sliding contact with the slightly convex exterior surface 23 of the wedge-shaped flange 21 of second vise jaw 14. This causes the thickness of metal between pipe 10 and the end of second yoke arm 18 to be decreased as the end of second yoke arm 18 rests on a thinner portion of the wedge-shaped flange 21 of second vise jaw 14. The decrease in wedging thickness with respect to the second vise jaw 14 equals the increase in wedging thickness with respect to the first vise jaw 14. This is reasonable since the distance between the yoke arms 18 of yoke 16 is fixed and does not change.

Rotation of frame 15 and vise jaws 14 in the clockwise direction adjusts the gripping forces of vise jaws 14 to counter the clockwise rotation of pipe 10. An increase in the amount of clockwise rotation causes an increase in the amount gripping force exerted by the vise jaw 14 opposing the clockwise rotation.

Since the mechanism described above is symmetrical, what has been stated for clockwise rotation is also true for counterclockwise rotation. When pipe 10 reverses the direction of its rotation, first vise jaw 14 plays the role formerly played by second vise jaw 14 and vice versa. The same is true for first and second yoke arms 18. The construction of the vise described above possesses the additional advantage that the change from restraining clockwise rotation of pipe to restraining counterclockwise rotation of pipe is completely automatic. No human intervention is necessary to change the mode of operation of the vise. The rotation of the pipe itself creates a gripping force to restrain the pipe's rotation. The restraining gripping force thus created is always applied opposite to the direction of rotation of the pipe.

What is claimed is:

1. An apparatus for gripping pipe, said apparatus comprising:

a frame for supporting a pipe to be gripped;

a housing for supporting said frame;

at least two vise jaws pivotally mounted on said frame with a first vise jaw disposed on a first side of said pipe when said pipe is supported on said frame and with a second vise jaw disposed on a second side of said pipe when said pipe is supported on said frame;

a yoke having a first arm for slidably moving along a surface of said first vise jaw to cause said first vise jaw to pivot into gripping contact with said pipe and having a second arm for slidably moving along a surface of said second vise jaw to cause said second vise jaw to pivot into gripping contact with said pipe, said first and second arms of said yoke being slidably mounted within said housing so that the ends of said first and second arms of said yoke slidably communicate with said first and second vise jaws, respectively;

means for biasing said yoke with respect to said housing to cause the ends of the first and second arms of said yoke to press against said first and second vise jaws, respectively; and means, mounted on said frame, for translating a rotational force acting on said pipe into a gripping force exerted on said pipe by said vise jaws.

2. An apparatus for gripping pipe, said apparatus comprising:

a frame for supporting a pipe to be gripped;

a housing for supporting said frame;

at least two vise jaws pivotally mounted on said frame with a first vise jaw disposed on a first side of said pipe when said pipe is supported on said frame and with a second vise jaw disposed on a second side of said pipe when said pipe is supported on said frame;

a yoke having a first arm for slidably moving along a surface of said first vise jaw to cause said first vise jaw to pivot into gripping contact with said pipe and having a second arm for slidably moving along a surface of second vise jaw to cause said second vise jaw to pivot into gripping contact with said pipe, said first and second arms of said yoke being slidably mounted within said housing so that the ends of said first and second arms of said yoke slidably communicate with said first and second vise jaws, respectively;

means for biasing said yoke with respect to said housing to cause the ends of the first and second arms of said yoke to press against said first and second vise jaws, respectively;

a first wedge-shaped flange forming a part of said first vise jaw, said first wedge-shaped flange having a slightly convex exterior surface in slidable communication with the end of said first arm of said yoke;

a second wedge-shaped flange forming a part of said second vise jaw, said second wedge-shaped flange having a slightly convex exterior surface in slidable communication with the end of said second arm of said yoke;

means for permitting said frame on which said first and second vise jaws are mounted to rotate slightly in either a clockwise or counterclockwise direction with respect to said external housing in which said yoke is slidably mounted;

said rotational force imparted by said pipe to said first vise jaw gripping said pipe being transmitted to said frame to cause said frame to rotate slightly with respect to said housing thereby permitting the end of the first arm of said yoke to slide further along said slightly convex exterior surface of said first wedge-shaped flange of said first vise jaw into tighter gripping contact with said first wedge-shaped flange under the action of a force exerted on said yoke by said means for biasing said yoke with respect to said housing and thereby permitting the end of the second arm of said yoke to slide back along said slightly convex exterior surface of said second wedge-shaped flange of said second vise jaw into tighter gripping contact with said second wedge-shaped flange under the action of said force exerted on said yoke by said means for biasing said yoke with respect to said housing;

said rotational force imparted by said pipe to said second vise jaw gripping said pipe being transmitted to said frame to cause said frame to rotate slightly with respect to said housing thereby permitting the end of the second arm of said yoke to slide further along said slightly convex exterior surface of said second wedge-shaped flange of said second vise jaw into tighter gripping contact with said second wedge-shaped flange under the action of a force exerted on said yoke by said means for biasing said yoke with respect to said housing and thereby permitting the end of the first arm of said yoke to slide back along said slightly convex exterior surface of said first wedge-shaped flange of said first vise jaw into tighter gripping contact with said first wedge-shaped flange under the action of said force exerted on said yoke by said means for biasing said yoke with respect to said housing.

* * * * *